United States Patent [19]

Rios

[11] 4,231,492

[45] Nov. 4, 1980

[54] APPARATUS AND METHOD FOR DISPENSING PUTTY-LIKE MATERIAL

[75] Inventor: Paul W. Rios, Strongsville, Ohio

[73] Assignee: Oatey Co., Cleveland, Ohio

[21] Appl. No.: 886,441

[22] Filed: Mar. 14, 1978

[51] Int. Cl.[3] ..... B67D 5/46

[52] U.S. Cl. ..... 222/1; 222/82; 222/95; 222/326; 222/327; 222/387

[58] Field of Search ..... 222/1, 95, 105, 325, 222/326, 327, 389, 386, 386.5, 387, 82, 83, 83.5, 80, 81, 87, 88

[56] References Cited

U.S. PATENT DOCUMENTS

| | | | |
|---|---|---|---|
| 1,576,982 | 3/1926 | Mass | 222/389 X |
| 2,083,479 | 6/1937 | Speare | 222/88 X |
| 2,139,143 | 12/1938 | Wiswell | 222/95 X |
| 2.351,688 | 6/1944 | Lee | 222/327 |
| 2,635,787 | 4/1953 | Bryant | 222/326 X |
| 3,327,906 | 6/1967 | Gömann | 222/389 |
| 3,401,842 | 9/1968 | Morrison | 222/95 X |
| 3,456,849 | 7/1969 | Sjostrand | 222/327 X |
| 3,847,304 | 11/1974 | Cohen | 222/326 X |
| 3,880,324 | 4/1975 | Roesel et al. | 222/389 X |
| 3,904,083 | 9/1975 | Little | 222/326 X |

*Primary Examiner*—Robert J. Spar
*Assistant Examiner*—Edward M. Wacyra
*Attorney, Agent, or Firm*—Maky, Renner, Otto & Boisselle

[57] ABSTRACT

Dispenser apparatus and method for dispensing putty-like material utilizes a plastic bag as the container for the putty-like material to facilitate shipment and storage of the material and provide for ease of refilling the dispenser with additional material. The apparatus includes an open top container mounted on a bottom support plate with valved outlet for receipt of the bag of putty-like material. In one form of the invention, a completely sealed bag of the putty-like material may be inserted into the container through the open top which is then closed by a top closure plate. The bottom of the plastic bag is then punctured by inserting a sharp instrument through the valved outlet to provide a passage therein through which the putty is selectively dispensed when the valve is moved to the open position and pressure is applied to the container contents as by a push plate within the container driven by an air cylinder mounted on the top closure plate. In another form of the invention, the bag is made of sufficient length to permit one end of the bag to be folded over the top of the container after the bag has been opened and before the top closure plate is attached to form a cuff to retain the bag in place during dispensing of the contents therefrom. The container contents may be pressurized either by placing a putty follow plate in the bag and admitting pressurized air directly into the container, or by urging a push plate against the container contents as by actuation of an air cylinder, as before.

24 Claims, 8 Drawing Figures

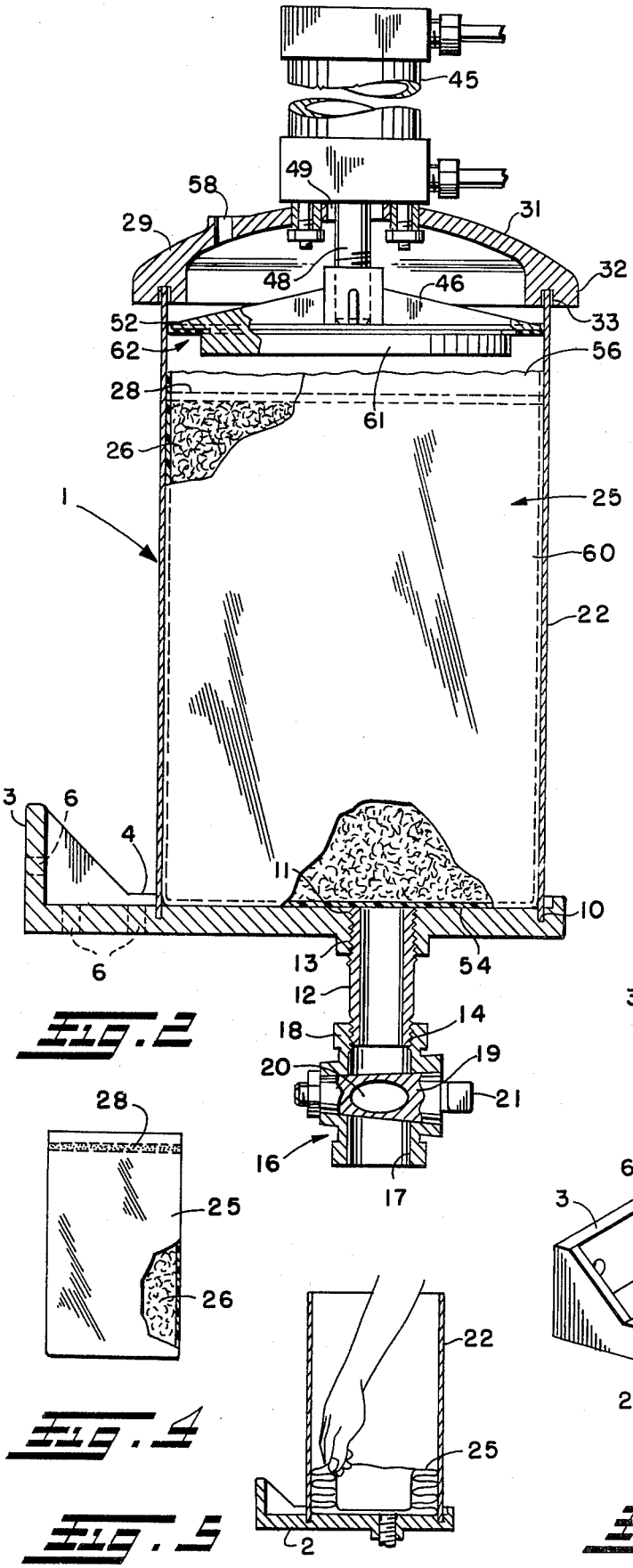
FIG. 2
FIG. 4
FIG. 5
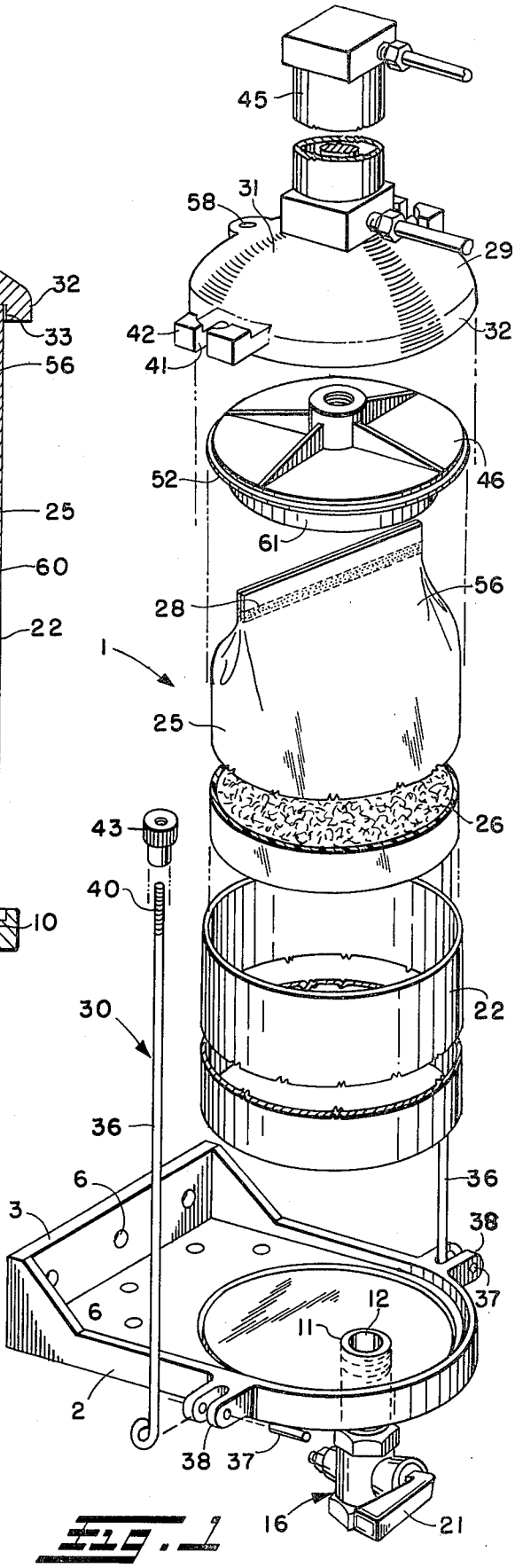
FIG. 1

APPARATUS AND METHOD FOR DISPENSING PUTTY-LIKE MATERIAL

BACKGROUND OF THE INVENTION

This invention relates generally, as indicated, to dispensers for putty-like material, and to a process for dispensing such material utilizing a flexible bag containing the putty-like material.

Receptacles containing putty-like material employing a follow plate in pressure contact with such material to force the same through an outlet opening at one end thereof are well known in the art; see, for example, U.S. Pat. Nos. 3,917,124 and 3,957,176. The receptacles disclosed in such patents are conventional metal cans or pails containing the putty-like material, with a follow plate in the container and the top cover sealed thereon at the factory prior to shipment to the customer. In use, the container is coupled to a regulated air pressure system to pressurize the material within the container for dispensing the material therefrom.

The prefilled metal cans significantly add to the cost and weight of the putty dispenser, and such metal cans are generally not reusable because of the cover seal which would normally be damaged if the cover were removed to permit refilling. Another objection to such containers is that great care is required to protect them against damage during shipping, and even then dents oftentimes occur which may preclude or at least adversely affect the movement of the follow plate within the container for dispensing purposes.

A treated cardboard cylindrical cartridge with removable end closure members has been used for shipping the contained putty. The material is dispensed from the cartridge with the end closure members removed by applying a valve plate to the bottom of the cartridge, mounting the cartridge and valve plate on the lower support, applying a top plate with regulated air supply to the top of the cartridge, and sealing the respective parts through a tie rod system extending upwardly from the bottom support. Although such a cartridge is lighter in weight and less expensive than the metal can receptacle described above, such cartridge may still be dented or damaged during shipment to preclude effective use of the same, and cannot readily be reused because of the required factory prefilling.

SUMMARY OF THE INVENTION

With the foregoing in mind, it is a principal object of this invention to provide a dispenser apparatus and method for dispensing putty-like material which utilizes a relatively inexpensive and lightweight container for shipping the putty-like material that is not likely to be damaged in shipment and can readily be field installed.

Another object is to provide such an apparatus and method which provides for ease of refilling the dispenser with additional material as required.

Still another object is to provide such an apparatus and method which permits remixing of the material immediately before use without having to open the container for the putty-like material and which is easily installed in the dispenser apparatus.

These and other objects of the present invention may be achieved by providing the apparatus with an open top dispenser having a bottom support plate with valved outlet. The dispenser is adapted to receive a flexible bag of putty-like material. In one form of the invention, a completely sealed bag of the putty-like material may be inserted into the dispenser through the open top which is then closed by a top closure plate. The bottom of the plastic bag is then punctured by inserting a sharp instrument through the valved outlet to provide a passage therein through which the putty is selectively discharged when the valve is moved to the open position and pressure is applied to the dispenser contents as by a push plate disposed within the dispenser and driven by an air cylinder mounted on the top closure plate.

Since the pressurized air is only supplied to the air cylinder, and not to the interior of the dispenser itself, the dispenser need not be airtight. Moreover, if for any reason the securing mechanism for the top closure plate should give way or any of the other dispenser parts fail, there is no danger that the high pressure air will cause any of the apparatus parts to be thrown about, since the air pressure is confined to the air cylinder which has a limited stroke.

The placement of the prefilled plastic bag of putty-like material in the dispenser not only simplifies refilling of the dispenser, but also substantially eliminates any need to clean up any of the dispenser parts prior to refilling. Also, if the top of the bag is kept substantially closed during the dispensing operation, so that the push plate presses against the bag itself rather than directly against the putty-like material, the tolerances between the push plate and dispenser interior need not be maintained nearly as close in order to keep the putty-like material from passing between the OD of the push plate and ID of the dispenser.

Of course, if the push plate does press against the bag during dispensing of the material therefrom, the sides of the bag will be compressed, causing the sides of the bag to fold up, which may interfere with the movement of the push plate as it nears the bottom of the dispenser. However, substantially all of the material can still be dispensed from the bag by providing a short extension on the push plate having an OD somewhat less than the OD of the push plate itself to provide in effect an annular recess around the outer periphery of the push plate to accommodate the folded up sides of the bag while still allowing the central portion of the push plate, formed by the extension, to push the top of the bag against the bottom intermediate the folded up sides.

In another form of the invention, the bag may be made of sufficient length to permit the upper end to be folded over the top of the container before the closure plate is attached to form a cuff to retain the bag in place during dispensing of the contents therefrom by the action of a push plate pressing directly against the bag contents. The driving force for the push plate may be obtained by admitting pressurized air to the container, or by actuation of an air cylinder mounted on the top of the closure plate, as before.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWING

In the annexed drawings:

FIG. 1 is an exploded perspective view partially broken away, showing the various components of a preferred form of dispensing apparatus in accordance with the present invention and illustrating the procedure for assembling same;

FIG. 2 is a vertical section through such dispensing apparatus;

FIG. 4 is a side elevation view, on a reduced scale, showing one form of flexible bag-like container for the putty-like material sealed at its top for shipment and storage purposes;

FIG. 5 is a vertical cross-section of the dispensing apparatus, also on a reduced scale, showing the top cover removed to permit removal of the flexible container after the putty-like material has been dispensed therefrom;

DETAILED DESCRIPTION OF THE PREFERRED EMBODIMENTS

Figure 3:
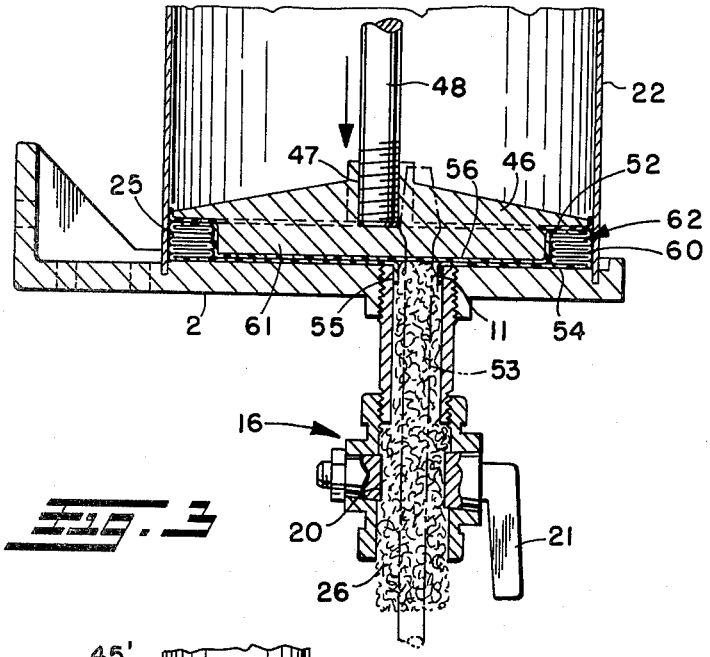
FIG. 3 is a fragmentary vertical section through the lower portion of such dispensing apparatus, illustrating in phantom lines an implement being inserted through the dispensing valve to puncture the plastic bag containing the putty-like material, and showing how the push plate accommodates the folded up sides of the bag around the periphery thereof as the push plate approaches the end of its stroke so that such folded up bag sides do not interfere with the push plate pressing the top wall of the bag against the dispenser bottom to dispense substantially all of the material therefrom.

Turning now in more detail to the drawing and initially to FIGS. 1 and 2, a preferred form of dispensing apparatus in accordance with this invention is generally indicated at 1 and includes a bottom, generally horizontally extending support plate 2 having a bracket 3 at one end thereof and a retention lip 4 extending around the top surface thereof. The bracket 3 and support plate 2 adjacent such bracket may be provided with a plurality of holes commonly denoted by reference numeral 6, with such holes selectively receiving fasteners to secure the support plate in horizontal cantilevered fashion from either a wall or support stand.

The horizontally extending support plate 2 is provided with an annular groove 10 in the top surface thereof. An internally threaded outlet orifice 11 is provided in the horizontal support plate radially inwardly of the annular groove, such orifice preferably being slightly offset with respect to the axial center of the groove toward the cantilevered end of the support plate as shown in FIGS. 1 and 2. A pipe nipple 12 having externally threaded ends 13, 14 is screwed at one end onto the threads of the outlet orifice 11 to extend downwardly therefrom. A plug valve 16 having a flow bore 17 therethrough and an internally threaded upper collar 18 is screwed onto the lower end of the pipe nipple 12. Such plug valve has a control member 19 with dispensing bore 20 therethrough rotatably mounted in the plug valve to extend across the flow bore. A handle 21 is connected to one end of control member 19 and is selectively operable to move the valve between its open position illustrated in FIG. 3 in which dispensing bore 20 is in aligned fluidic communication with flow bore 17 through valve 16 and its closed position shown in FIG. 2 in which the dispensing bore of the control member is at right angles to the fluid flow through flow bore to block the same. As will be described in more detail hereafter, the selective movement of such valve 16 between its open and closed positions controls the dispensing of putty-like material from a dispensing cylinder 22 when in properly assembled relation on the support plate 2.

Such dispensing cylinder 22 desirably consists of a hollow, open ended cylindrical member or tube, made of metal or other suitable material, and adapted to be mounted on the horizontally extending support plate 2 by positioning the lower end thereof in the annular groove 10. When thus positioned, the open top of the cylinder is ready for receipt of bagged putty-like material, described hereafter.

The bag-like container 25 which contains the putty-like material 26 is preferably made from a suitable plastic material such as polypropylene to facilitate heat sealing thereof. An outer coating of nylon or other suitable material may be laminated or fused to the polypropylene bag to act as a barrier to preclude the solvent in the body filler material from seeping through the polypropylene.

Each plastic bag is selected in its dimensions properly to fit the open top container 22 with which it is to be used both from a diametrical standpoint and from a length standpoint, as will be discussed in more detail hereafter. The flexible bags are filled with the desired quantity of putty-like material which typically may be 2 to 5 gallons. When the filling is complete, the plastic bags are closed above the putty-like material as by heat sealing as shown at 28 in FIG. 4 to retain the material therein for shipment and storage purposes.

The filled bags can readily be stacked and shipped in varying numbers in cartons of varying sizes, with little danger of damage, and none of the denting problems which oftentimes occur when metal containers are used for the putty-like material. The plastic bags are also relatively inexpensive compared to the previously used metal containers and much lighter and easier to handle. Moreover, the filled plastic bags require much less room for storage and can be stored for significant lengths of time without fear of operational problems caused by solvent separation from the putty material during storage since the putty-like material can readily be mixed and redistributed immediately before use by kneading the material in the plastic bag to effect such redistribution without first having to open the bag. The necessity for remixing can also readily be determined by visual inspection of the bag if the bag is made of a transparent material.

When a fresh supply of putty-like material is needed for use, a completely closed (sealed) bag 25 of putty-like material may be lowered into the mounted cylinder 22 until the bottom of the bag comes to rest on the horizontally extending support plate 2. The filled bag preferably has a diameter substantially equal to the inner diameter of the cylinder so that the cylinder adequately supports the bag around its entire peripheral extent. When in such position, all of the putty-like material in the bag is within the confines of the cylinder with the top of the bag below the top of the cylinder a suitable distance, depending on the amount of the body filler material within the bag.

Next a top closure plate 29 is positioned on the top of cylinder 22 and secured in place by any suitable means, for example, a tie rod system 30, as described hereafter. The top closure plate may be cast from aluminum and may include a domed central portion 31 and a reinforced annular attachment flange 32 extending downwardly from the lower peripheral extent of the same. The flange 32, like the support plate 2, includes an annular groove 33 therein which receives the top edge of the cylinder 22.

As best shown in FIG. 1, the tie rod system 30 includes a pair of tie rods 36 pivotally connected as by pins 37 to diametrically opposed clevises 38 extending radially outwardly from the rim 4 of the horizontal support plate. The tie rods extend upwardly from such support plate with the threaded terminal ends 40 thereof received in and extending upwardly beyond slots 41 in pressure lugs 42 protruding outwardly from the top closure plate 29. Nuts 43 are then threaded downwardly along such tie rods to bear against the pressure lugs to secure the top closure plate in place.

An air cylinder 45 may be bolted or otherwise secured to the top closure plate 29 to provide the necessary driving force to a push plate 46 to pressurize the dispenser contents. As clearly shown in FIGS. 1 through 3, the push plate is provided with a threaded fitting 47 for threaded engagement with the distal end of the air cylinder rod 48, which extends through an opening 49 in the top closure plate into the interior of the dispenser. The push plate itself may be made of metal or other suitable material having the required strength and rigidity to pressurize the dispenser contents.

The major OD of the push plate 46 approximates the inner diameter of the dispenser cylinder 22 to keep the material being dispensed forward of the push plate and not permitting the material to be displaced to the back side thereof resulting in undesirable scrap material. However, because the material 26 is confined within the flexible bag 25, the tolerances between the OD of the push plate and ID of the dispenser cylinder need not be maintained nearly as close as would be required if the material was not confined within the bag. There can be, for example, as much as a 1/32" diametral clearance between the push plate and cylinder without the bag being squeezed between the push plate and cylinder wall. This has the advantage that standard tubing which is made without holding the ID tolerances very close can be used for the dispenser cylinders without having to machine the ID of the tubing.

To further insure against material being pushed up between the push plate and cylinder wall, a flexible disc 52 made of rubber or plastic or other suitable material may be attached to the outer periphery of the push plate. As shown, the flexible disc has an outer diameter somewhat greater than the inner diameter of the dispenser cylinder to wipe the sides of the dispenser cylinder and keep the material below the push plate for positive displacement thereby during the dispensing operation.

When the dispenser has been thus assembled for operation, the dispenser valve 19 may be opened to permit insertion of elongated rod-like tool, such as a screwdriver 53, up through the valve as illustrated in phantom lines in FIG. 3 for puncturing the bottom 54 of the bag 25 in vertical alignment with the outlet orifice 11 to provide a material passage 55 in the bag. The screwdriver is then withdrawn and the dispenser valve returned to its closed position.

Although a screwdriver is illustrated as the puncturing implement, any sharp tool may be used for that purpose, or other means may be employed to provide the desired passage in the plastic bag. For example, the bag could have lines of weakness at the desired location of the material passage with such lines of weakness being sufficient to contain the material during shipment and storage but being thin enough to break once pressure is applied to the material through the push plate being forced downwardly by air pressure.

With the bag punctured for operation, the putty-like material within the dispenser may be pressurized by admitting air pressure into the air cylinder 45 which urges the cylinder rod 48 and thus the push plate 46 connected thereto downwardly as indicated by the arrow in FIG. 3, whereby material may be selectively dispensed from the dispenser simply by turning the handle 21 to place the dispenser valve 16 in its open position, thus providing a flow path for the putty-like material downwardly through the bag passage and valve. When the desired amount of putty-like material has been dispensed, the flow of material is shut off by returning the valve to its closed position. The air pressure may be left on or turned off as desired during periods in which material is not dispensed from the container, depending on the lapse of time between each dispensing operation.

While not absolutely necessary, it may be desirable to provide a vent passage in the top 56 of the bag, as by jabbing the top of the bag with a small diameter rod or screwdriver, after the bag has been placed in the dispenser cylinder and before the top closure plate is put in place, to permit escape of any air entrapped in the putty-like material during dispensing. Otherwise, any air that is entrained within the material will be forced out the valve with the material, causing some bubbling in the material.

The space above the push plate 46 may either be vented through the opening 49 in the top closure plate 31 through which the air cylinder rod 48 extends, or a separate vent opening 58 may be provided, so that a vacuum is not created above the push plate during its downward movement, and to permit the escape of any air beneath the push plate during such downward movement.

The stroke of the air cylinder 45 should of course substantially correspond to the distance required in order to move the push plate 46 from its fully retracted position, shown in FIG. 2, to its fully extended position, shown in FIG. 3, in close proximity to the bottom support plate. As the push plate moves downwardly, the sides 60 of the bag will continue to fold up ahead of the push plate, to the point where, as the push plate approaches the end of its stroke, the folded up sides could interfere with the downward movement of the push plate, resulting in increased scrap material particularly in the region between the top and bottom walls 56, 54 of the bag. To minimize such scrap, the push plate 46 is desirably provided with a central extension 61 of a lesser OD than the major OD of the push plate, thus providing in effect an annular recess or groove 62 around the periphery of the extension for accommodating the folded up sides of the bag while permitting the central extension of the push plate to force out the remaining material centrally of the bag as schematically illustrated in FIG. 3. Of course, if the annular recess formed by the push plate extension 61 is too large, there will be scrap material remaining in the recess itself, whereas if the recess is too small, the folded up sides of the bag will still interfere with the downward movement of the push plate near the end of its stroke resulting in increased scrap material between the push plate and lower support plate 2.

Although the dimensions of the various dispenser parts may obviously be varied, depending on the desired storage capacity of the dispenser and the preferred size and shape of the prefilled bags for shipment and storage, in the preferred form of the dispenser, the dispenser cylinder has an ID of approximately 7.968 inches and a length of approximately 12 inches, whereas the push plate itself has a major OD of approximately 7.890 inches, and the extension has an OD of approximately 6.890 inches and a length of approximately $\frac{3}{8}$ inch.

The air cylinder itself also has a stroke of approximately 12 inches, that being the approximate length of the dispenser cylinder, and the air cylinder piston preferably has a diameter of approximately $2\frac{1}{2}$ inches in order to develop approximately 350 lbs. of force on the material using 70 lbs. of air pressure. A larger air cylinder piston would of course permit reduced air pressure to be used to obtain the same working pressure, and vice versa.

Upon completion of the dispensing operation, after substantially all of the putty-like material has been dispensed from the bag, and the air pressure has been turned off, the tie rod system 30 may be released by removing the nuts 43 and withdrawing the top closure plate 29 from the dispenser cylinder 22 to permit removal and replacement of the bag 25 with a new bag containing a fresh supply of putty-like material. FIG. 5 illustrates the ease with which the bag may be removed simply by reaching into the dispenser cylinder and pulling the bag outwardly therefrom. The used bag is of course discarded, but the follow plate 46, which remains attached to the air cylinder 45, may be reused indefinitely.

Because the putty-like material is confined to the interior of the bag, little or no residue of the putty-like material is left along the walls of the dispenser cylinder or on the push plate during the dispensing operation, whereby very little or no clean up of the push plate and cylinder is required. The top and bottom plates may also be reused with minimum clean up being required. A new bag is inserted within the cylinder and the top and bottom plates assembled in the manner previously described.

Figure 6:
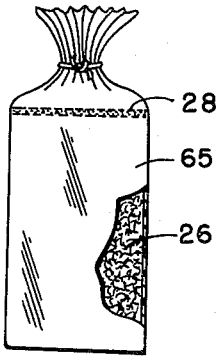
FIG. 6 is a side elevation view, on a reduced scale, of another form of flexible bag-like container for the putty-like material, similar to the container of FIG. 4, but of a much greater length, to permit the top of the bag to be folded over the top of the container to form a cuff to retain the bag in place during the dispensing operation.

FIG. 6 shows a modified form of plastic bag 65 for the putty-like material 26, which is substantially the same as the bag 25 previously described, except that the bag extends substantially beyond the point to which it is filled, beyond the heat seal line 28. More particularly, the length of the bag is such that when the bag is placed within the confines of the dispenser cylinder, the top of the bag extends upwardly beyond the top of the cylinder a suitable distance, for example, 5 inches, to permit the top of the bag to be folded over the top of the cylinder after opening the bag to form an annular cuff 66 as shown in FIG. 7 for retention of the bag in position while the push plate 67 moves downwardly interiorly of the bag.

In this case, the follow plate 67 is substantially flat across its entire face. There is no need for a push plate extension of reduced diameter to accommodate the folded up sides of the bag as the push plate approaches the end of its stroke, since the bag is retained against movement due to the draping of the top of the bag over the top of the dispenser cylinder, as noted above. Otherwise, the details of construction of the dispenser apparatus of FIG. 7 is substantially the same as the dispenser apparatus previously described, and the same reference numerals followed by a prime symbol are used to designate like parts. The top closure plate 29', of course, receives the top edge of the cylinder 22' and the plastic bag folded thereover in the annular groove 33' therein.

Figure 7:
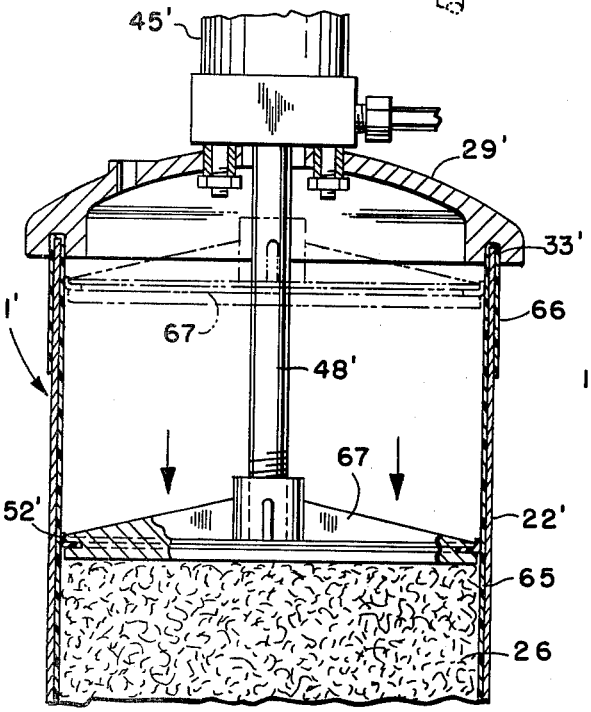
FIG. 7 is a fragmentary vertical section through the upper portion of the dispensing apparatus of FIGS. 1 and 2, but utilizing the modified form of flexible container shown in FIG. 6.

When the dispenser apparatus of FIG. 7 has been thus assembled for operation, the dispenser valve may be opened to permit insertion of an elongated rod-like tool up through the valve for puncturing the bottom of the bag as before. Next air pressure is supplied to the air cylinder 45', which causes the push plate 67 to push directly against the material, so that the material may be selectively dispensed from the container by turning the valve handle to place the dispenser in its open position. As the material is dispensed, the push plate 67 moves downwardly within the bag, causing the material to be pushed out the valve by the push plate. The flexible disc 52' around the periphery of the push plate assists in wiping the sides of the bag and keeping the material below the push plate for positive displacement thereby.

After substantially all of the putty-like material has been dispensed from the dispenser, and the air pressure has been turned off, the tie rod system may be released and the top closure plate 29' with air cylinder 45' and push plate 67 carried thereby removed to permit removal and replacement of the bag with a new bag containing a fresh supply of putty-like material.

Figure 8:
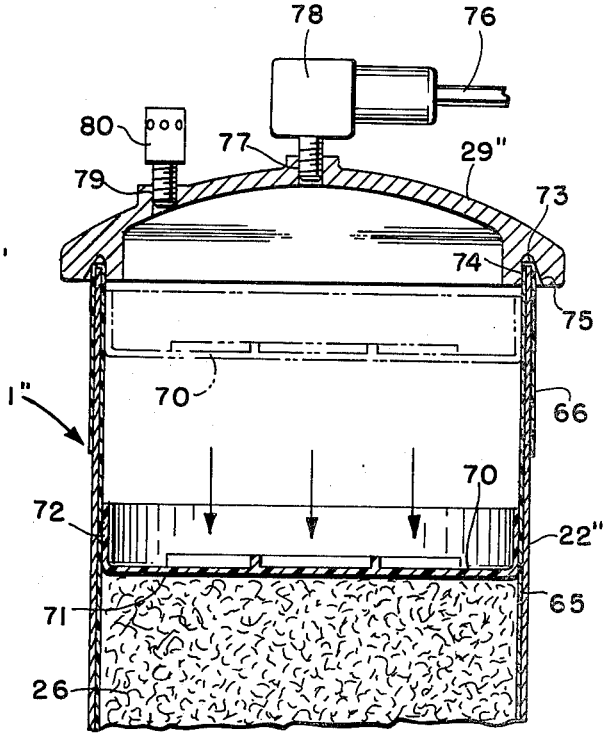
FIG. 8 is a fragmentary vertical section through the upper portion of a modified form of such dispensing apparatus, similar to FIG. 7, but in which the pressurized air is admitted directly into the dispensing cylinder to force a push plate contained therein against the putty-like material within the flexible container.

FIG. 8 illustrates yet another dispensing apparatus embodiment 1'', which is quite similar to the material dispensing apparatus 1' of FIG. 7, except that the dispenser cylinder 22'' is sealed so that regulated pressurized air may be admitted directly into the interior of the cylinder, to force a separate follow plate 70 downwardly within the bag 65 of putty-like material disposed therein into direct pressure engagement with the bag contents. The follow plate 70 is preferably made of plastic, with a substantially horizontally extending pressure wall 71 resting directly on the putty-like material and an upwardly extending peripheral wiping flange 72. The outer diameter of the wiping flange approximates that of the inner diameter of the plastic bag and dispenser cylinder 22'' and may taper outwardly to a slightly greater OD as shown in U.S. Pat. No. 3,790,038 for downwardly directed sliding movement therealong under the influence of air pressure, with such movement wiping the sides of the bag and keeping the material below the follow plate for positive displacement thereby.

Both the top closure plate 29'' and bottom support plate include an annular groove 73 therein for receipt of the opposite ends of the dispenser cylinder 22''. However, rather than having both of the walls of the grooves 73 substantially vertical as shown in the previous embodiments, preferably only one of the walls 74 is vertical and the other wall 75 is inclined radially inwardly from the flange surface to the bottom of the other straight wall 74, whereby when the top closure plate 29″ is drawn downwardly by tightening the nuts, such downward movement of the top closure plate causes the top of the cylinder and folded bag to be wedged inwardly along the inclined wall 75 of the groove 73 to effect a tight seal therebetween and also results in the bottom of the cylinder being forced downwardly and radially inwardly into wedging engagement with the walls of the groove in the bottom support plate similarly to effect a tight seal therebetween.

A pressurized air supply line 76 may be attached to a fitting 77 in the top closure plate using an air regulator 78 to control the pressure on the air being admitted into the sealed dispenser through the top closure plate 29″. The air regulator is preferably factory preset to prevent any tampering with the setting of the regulator which could cause an overpressure condition within the dispenser. As a further safety precaution, the top closure plate may be provided with a further offset fitting 79 for receipt of a safety valve 80 to release any excess air from the sealed dispenser in the unlikely event that an overpressure condition should develop therewithin. The pressurized air which is admitted into the dispenser cylinder of course acts directly on the push plate rather than on a piston in an air cylinder; otherwise, the dispensing procedure is substantially the same.

From the foregoing, it will now be apparent that the various dispenser apparatus of the present invention permit dispensing of putty-like material from a relatively inexpensive and lightweight flexible container which greatly facilitates shipping and storage of the putty-like material and can readily be field installed.

The embodiments of the invention in which an exclusive property or privilege is claimed are defined as follows:

1. An apparatus for dispensing putty-like material comprising a hollow, open ended dispenser cylinder, a bottom support plate for said cylinder substantially to close off the bottom opening therein, said support plate having an outlet passage, a dispensing valve for opening and closing said outlet passage, said dispensing valve when moved to the open position having a valve passage in vertical coaxial alignment with said outlet passage, a flexible plastic-like bag containing the putty-like material adapted to be lowered into said cylinder, said bag having a bottom of said flexible plastic-like material which rests on said support plate and covers said outlet passage after lowering of said bag into said cylinder, said dispensing valve when in such open position permitting the insertion of a rod-like device through said outlet passage and said valve passage for puncturing said bottom of said bag to provide an outlet aperture in said bag in vertical alignment with said valve passage and said outlet passage in said support plate, a push plate in said cylinder including means for contacting the peripheral extent of said cylinder for vertically downwardly directed wiping movement therealong, a top closure plate for said cylinder, and means for urging said push plate downwardly within said cylinder to pressurize the putty-like material within said cylinder, so that when the dispensing valve is moved to the open position, the putty-like material will be dispensed from said apparatus.

2. The apparatus of claim 1 wherein said bag is made of multi-layers of plastic, including an inner-most layer of a heat sealable plastic and an outer layer providing a barrier to any solvent evaporation from the putty-like material.

3. The apparatus of claim 1 wherein said push plate presses directly against the top of said bag when urged downwardly within said cylinder pushing said bag along ahead of said push plate during dispensing of the putty-like material from said apparatus.

4. The apparatus of claim 3 wherein said means for urging said push plate downwardly within said cylinder comprises an air cylinder mounted on said top closure plate exteriorly of said cylinder, said air cylinder having a rod extending through an opening in said top closure plate into the interior of said cylinder, said push plate being attached to said rod for movement therewith.

5. The apparatus of claim 3 wherein said push plate has a major diameter approximately the same as the inner diameter of said cylinder, and said push plate includes a central extension of a lesser outer diameter than said major diameter, thus providing an annular recess around the periphery of said extension to accommodate the sides of said bag which fold up during the dispensing operation, whereby the folded up sides do not interfere with the end movement of said extension pushing the top wall of said bag against the bottom wall.

6. The apparatus of claim 1 wherein the top of said bag is folded over the top of said cylinder to form a cuff positively to retain said bag in place during the dispensing operation, said push plate being disposed within said bag in direct contact with the putty-like material contained therein.

7. The apparatus of claim 6 wherein said top closure plate has means selectively to communicate with a regulated pressurized air supply, and means are provided for drawing said top closure plate downwardly against said cylinder to establish a seal between the respective ends of said cylinder and said top and bottom plates, whereby when pressurized air is introduced into said sealed cylinder through said top closure plate, said push plate is urged against the putty-like material to pressurize same.

8. The apparatus of claim 7 wherein an annular groove having a vertical inner wall and an inclined outer wall is provided in each of said top and bottom plates, said grooves respectively receiving the corresponding ends of said cylinder to provide a wedging action thereagainst during drawing of said top cover plate downwardly to establish a positive seal therebetween.

9. The apparatus of claim 8 wherein said means to draw comprises tie rods extending upwardly from said bottom support plate and terminating with a threaded portion extending through and upwardly beyond pressure lugs on said top closure plate, and nuts threaded onto the terminal portions of said tie rods and bearing against said pressure lugs to force said top cover plate downwardly against the top of said cylinder.

10. A method of dispensing putty-like material comprising the steps of removing a top closure plate from an open top cylinder, lowering a flexible plastic-like bag filled with putty-like material into such open top cylinder so that the bottom of such bag which is also made of such flexible plastic-like material rests on a support plate and covers an outlet passage in the support plate at the bottom of such cylinder thereof, opening a valve connected to such outlet passage, such valve when open having a valve passage in vertical coaxial alignment with such outlet passage, inserting a rod-like device through such outlet passage and such valve passage to puncture the bottom of the bag in axial alignment with the outlet passage and valve passage providing an opening in the bottom of the bag in fluidic communication with the valve passage and outlet passage for discharge of putty-like material, removing the rod-like device from the outlet passage and valve passage, closing such valve, replacing such top closure plate on such cylinder, and urging a push plate downwardly within the cylinder to pressurize the putty-like material within the bag, whereby upon movement of the valve to an open position, the putty-like material will be dispensed through such outlet passage.

11. The method of claim 10 wherein such push plate presses directly against the top of the bag when urged downwardly within the cylinder pushing the bag along ahead of the push plate during dispensing of the putty-like material through such outlet passage.

12. The method of claim 11 further comprising the steps of placing said top closure plate on the top of the cylinder prior to urging the push plate downwardly against the putty-like material, such top closure plate having an air cylinder mounted thereon, with a rod extending through an opening in the top closure plate into the interior of the cylinder, such push plate being attached to such rod for movement therewith.

13. The method of claim 12 wherein such push plate has a major diameter substantially the same as the inner diameter of such cylinder and such push plate includes an extension of a lesser outer diameter than such major diameter, thus providing an annular recess around the periphery of such extension to accommodate the sides of the bag which fold up during the dispensing operation so that the folded up sides do not interfere with the end movement of the extension pushing the top wall of the bag against the bottom wall as the push plate approaches the end of its stroke.

14. The method of claim 10 wherein such bag has an open top, further comprising the steps of folding the open top of the bag over the top of the cylinder to form a cuff for retaining the bag in place prior to the dispensing operation, the push plate being disposed in contact with the top surface of the putty-like material in the bag.

15. The method of claim 14 wherein the top closure plate is placed in sealed engagement on the top of the cylinder and has a regulated air supply inlet means therein, and the interior of the container is pressurized through such regulated air supply inlet means to urge the push plate downwardly against the putty-like material.

16. The method of claim 14 wherein the bag dimensions are such that the bag fits snugly within the cylinder along its peripheral extent and the top thereof extends sufficiently past the top of the cylinder to form the fold over cuff, such bag being filled with putty-like material to a depth less than the height of the cylinder and having a seal above the putty-like material therein spaced from the bottom of the bag by a distance less than the height of the cylinder so that the top of the cylinder which forms the fold over cuff is not contacted by the putty-like material in the bag, further comprising the step of breaking the seal to open the top of the bag when ready for use prior to placing the bag in the open top cylinder.

17. The method of claim 16 wherein the push plate is placed into the bag in contact with the top surface of the putty-like material after the bag has been placed into the cylinder and the top of the bag has been folded over the top of the cylinder to form a cuff for retaining the bag in place, such push plate having a diameter substantially conforming to the inner diameter of the bag and cylinder.

18. The method of claim 14 wherein said support plate forms the bottom of the cylinder and contains the valve dispenser, and during the step of replacing a top closure plate on the top of the cylinder, the top closure plate is drawn toward the support plate by a tie rod system extending upwardly from the latter to clamp and seal the cylinder therebetween.

19. The method of claim 18 wherein the top closure plate and support plate are each provided with an annular groove to receive the opposite ends of the cylinder to assist in sealing the latter to the former during drawing of the top closure plate toward the support plate, each annular groove including a substantially vertical radially inner wall and a tapered radially outer wall to provide a wedging action as the top closure plate is drawn toward the support plate to assist in forming a tight seal.

20. The method of claim 10 further comprising the step of kneading the bag to mix the putty-like material contained therein prior to placing the bag into the open top cylinder.

21. The method of claim 20 wherein the flexible bag includes an inner layer of a heat sealable plastic and an outer layer of a barrier forming material to preclude evaporation of solvent from the contained putty-like material, such flexible bag having a heat seal at the top thereof to contain the putty-like material therein during shipment and storage.

22. The method of claim 10 further comprising the steps of removing the flexible bag from the cylinder after dispensing the putty-like material therefrom and placing another flexible bag of putty-like material within the open top cylinder.

23. An apparatus for dispensing putty-like material comprising a dispenser cylinder having a bottom closure member containing an outlet passage, a dispensing valve for opening and closing said outlet passage, said dispensing valve when moved to the open position having a valve passage in vertical coaxial alignment with said outlet passage, a flexible plastic-like bag containing the putty-like material adapted to be lowered into said cylinder and supported by said bottom closure member, said dispensing valve when in such open position permitting the insertion of a rod-like device through said outlet passage and said valve passage for puncturing said bottom of said bag to provide an outlet aperture in said bag in vertical alignment with said valve passage and said outlet passage in said bottom closure member, a push plate in said cylinder, a top closure member for said cylinder, and means for urging said push plate downwardly within said cylinder to pressurize the material within said cylinder, so that when the dispensing valve is moved to the open position, the putty-like material will be dispensed from said apparatus.

24. A method of dispensing putty-like material comprising the steps of placing a flexible plastic-like bag filled with putty-like material into an open top cylinder having a valve dispenser in fluid communication with an outlet passage in the bottom of such cylinder, opening a valve connected to such outlet passage, such valve when open having a valve passage in vertical coaxial alignment with such outlet passage, inserting a rod-like device through such outlet passage and such valve passage to puncture the bottom of the bag in axial alignment with the outlet passage and valve passage providing an opening in the bottom of the bag in fluidic communication with the valve passage and outlet passage for discharge of putty-like material, removing the rod-like device from the outlet passage and valve passage, closing such valve, and urging a push plate downwardly within the cylinder to pressurize the putty-like material within the bag, whereby upon movement of the valve to an open position, the putty-like material will be dispensed through such outlet passage.

* * * * *